US006098328A

United States Patent [19]

Belfiglio et al.

[11] Patent Number: 6,098,328

[45] Date of Patent: Aug. 8, 2000

[54] DISPLAY DEVICE

[75] Inventors: John Belfiglio, Havertown, Pa.; Peter Rohrbacher, Bordentown, N.J.

[73] Assignee: Congoleum Corporation, Mercerville, N.J.

[21] Appl. No.: 09/026,945

[22] Filed: Feb. 20, 1998

[51] Int. Cl.[7] ..... G09F 3/20

[52] U.S. Cl. ..... 40/658; 40/642.02; 40/649

[58] Field of Search ..... 40/649, 642.02, 40/658, 611, 765

[56] References Cited

U.S. PATENT DOCUMENTS

| | | | |
|---|---|---|---|
| D. 381,834 | 8/1997 | Potter et al. | D6/409 |
| 864,984 | 9/1907 | McPhee | 40/649 X |
| 1,116,484 | 11/1914 | Ralph . | |
| 1,288,395 | 12/1918 | Duncan | 40/649 X |
| 1,731,692 | 10/1929 | Weindel, Jr. | 40/658 X |
| 2,208,019 | 7/1940 | Darling | 40/649 |
| 2,981,018 | 4/1961 | Hopp et al. | 40/16 |
| 3,137,954 | 6/1964 | King | 40/658 |
| 3,181,706 | 5/1965 | Mandel | 211/163 |
| 3,924,749 | 12/1975 | Weston | 211/4 |
| 4,149,331 | 4/1979 | Prager | 40/649 X |
| 5,125,505 | 6/1992 | Kurosaki | 40/649 X |
| 5,377,434 | 1/1995 | Wilson | 40/611 |
| 5,442,873 | 8/1995 | Vogler | 40/649 |
| 5,515,632 | 5/1996 | Gebka et al. | 40/642 |
| 5,625,969 | 5/1997 | Vogler | 40/611 |
| 5,626,926 | 5/1997 | Roberts | 40/611 X |
| 5,864,977 | 2/1999 | Alvern | 40/658 |

FOREIGN PATENT DOCUMENTS 2168383 7/1996 Canada .

*Primary Examiner*—Anthony Knight
*Attorney, Agent, or Firm*—Synnestvedt & Lechner LLP

[57] ABSTRACT

A page frame display device is disclosed that includes biasing ribs which urge or bias opposing sides of an insertion slot towards each other to form a pinch point, thereby keeping in place display sheets that are inserted into the device. The ribs are external to the insertion slot, so they do not impede the insertion of display sheets into the device.

8 Claims, 8 Drawing Sheets

DISPLAY DEVICE

FIELD OF THE INVENTION

This invention relates to display frames for sheet materials and more particularly to point-of-sale display frames for displaying sheet flooring, carpeting, paneling and the like.

BACKGROUND OF THE INVENTION

It is common to display samples of sheet materials such as placards, flooring, carpeting, paneling and the like in display frames that hold one or more sheets of the material such that the material can be easily examined by a potential purchaser.

Typically, such devices comprise a rectangular supporting frame having four edge members. Typically three of the edge members ("the channel edges") comprise U-shaped channels and the fourth edge member ("the slotted edge") has an access slot into which the sheet material is inserted. The resulting structure "frames" the sheet-material so that a potential purchaser, for example, can touch the sheet material for evaluation. Examples of such display frames can be found in U.S. Pat. No. 5,442,873 to Vogler and U.S. Pat. No. Des 381,834 to Potter et al.

A series of the frames are often mounted on hinges or pivot pins and placed in a rack so that a plurality of the frames, with the sheet material inserted therein, can be flipped through by the consumer when conducting the evaluation. Examples of rack mounted display frames are found in U.S. Pat. No. 3,924,749 to Weston; U.S. Pat. No. 1,116,484 to Ralph; and U.S. Pat. No. 3,181,706 to Mandel.

Certain problems exist with the prior art display frames. The access slot in the slotted edge must be wide enough for insertion of the sheet material into the U-shaped channels of the remaining three channel edges. As a result, when the display frames are moved by the potential purchaser, there is a tendency for the sheet material to slide out through the access slot. Further, if a large page-frame is used to display a large piece of sheet material, the weight of the material bears down on the frame when it is oriented vertically and can cause deformation of the frame.

Attempts have been made at avoiding the problem of having the sheet material slide out of the frame. U.S. Pat. No. 2,981,018 to Hopp et al. teaches the use of a "spring finger" attached at one end of U-shaped channels that form the frame. The spring finger is located adjacent the open end of the channels proximate to the open (slotted) edge of the frame. The spring finger is biased to contact the corner of an inserted placard and essentially blocks the insertion slot to hold the placard in place. The extreme end of the finger projects through the slot of the frame so that it can be pushed out of the way to release the spring pressure and free the placard for removal from the frame or to allow a placard to be inserted into the frame.

Although this is an improvement over prior frames which make no accommodation for slippage of the sheet material, this still requires special assembly of the spring finger which is a costly additional manufacturing step.

Various other patents teach slotted holders in which projections project into the slotted edge for engaging the displayed placard/sheet. The Vogler patent discloses nibs or tooth-like projections extending inwardly into and bridging the opening of the slotted edge of the frame. The nibs are formed on at least one of the two strips that define the slotted opening, and they are of a thickness such that a nib on one strip will make contact with the opposite strip, thereby holding the placard in the frame. Vogler utilizes the tendancy of the strips to normally "flex slightly toward one another" to enable the thickness of the nibs to be "slightly less" than the width of the slot opening. However, the projections into the opening of the frame disclosed in Vogler still reduce the space into which the sample can be inserted by placing an impediment in the insertion path of the sample.

SUMMARY OF THE INVENTION

It is the purpose of this invention to provide a display device in which a display sheet is retained within the page frame without the inclusion of an impediment in the insertion path. The present invention provides a page frame display device that includes biasing ribs which urge or bias opposing slats that define an insertion slot towards each other to form a pinch point, thereby keeping in place display sheets that are inserted into the device.

DETAILED DESCRIPTION OF THE EMBODIMENT

Figure 1:
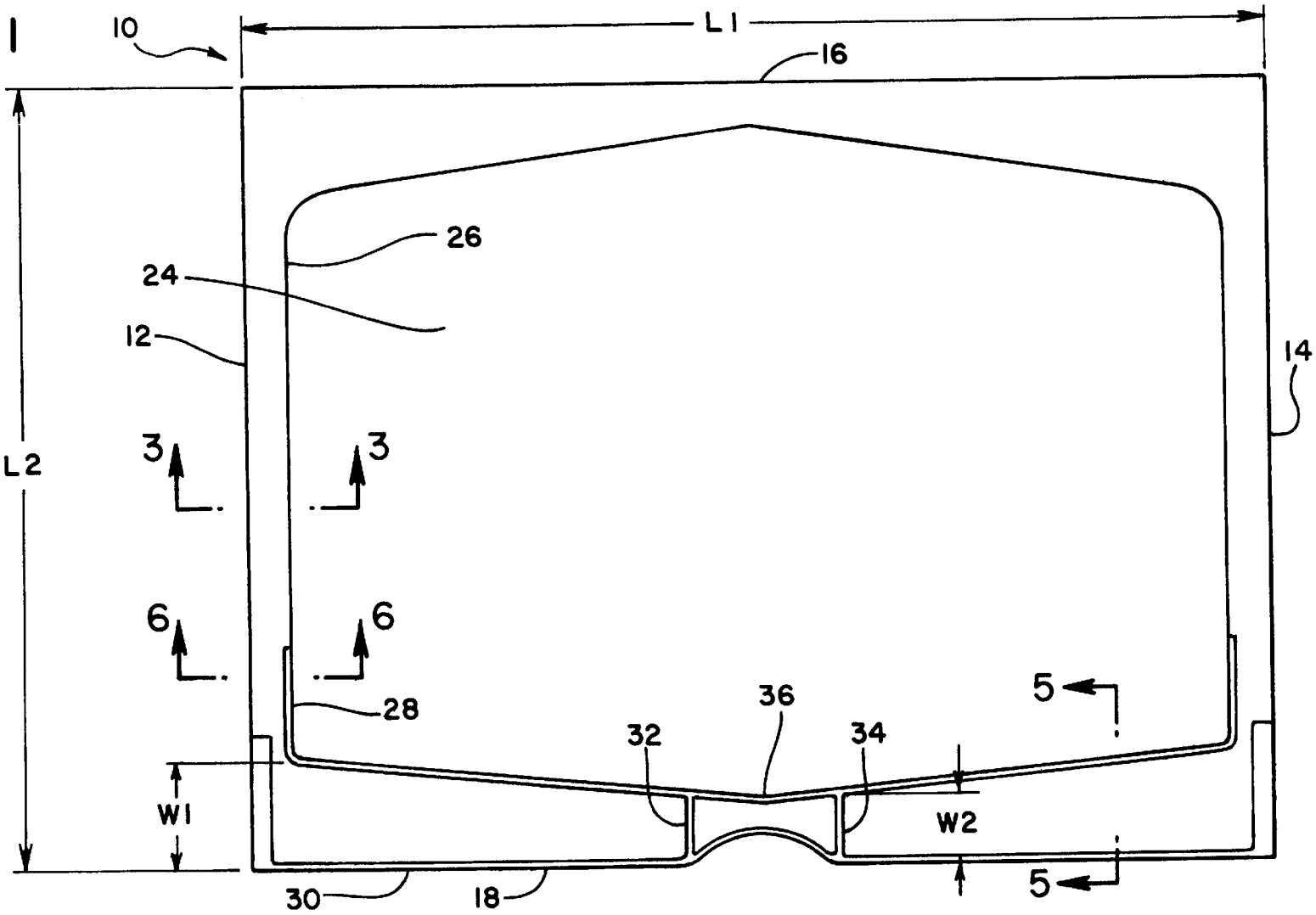
FIG. 1 is a front plan view of a page frame in accordance with the present invention.
Figure 2:
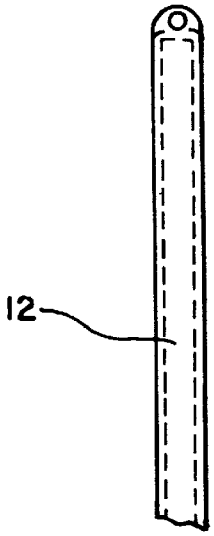
FIG. 2 is a side elevational view (partial) of the left side of the page frame depicted in FIG. 1.

FIGS. 1 and 2 are front and side views, respectively, of a display frame 10 according to the present invention. Display frame 10 comprises a pair of parallel elongate side frames 12 and 14, the ends of each of said elongate side frames 12 and 14 being joined by a second set of parallel elongate side frames 16 and 18. Thus formed, the side frames 12, 14, 16, and 18 form an essentially rectangular page frame. An open display area 24 is created which allows the user to touch a sheet sample or samples inserted in the frame. Open display area 24 is defined by an inner edge 26 of the page frame 10.

Figure 3:
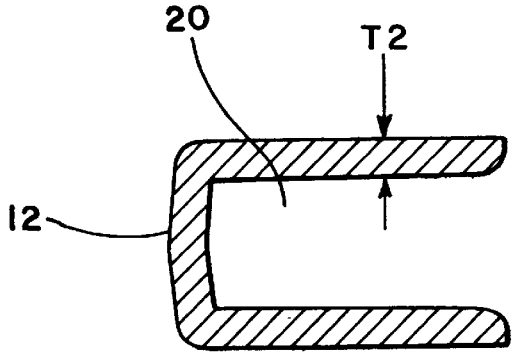
FIG. 3 is a cross-section of the left side of the page frame depicted in FIG. 1, taken through line 3—3.

FIG. 3 is a cross-section of elongate side frame 12 taken through line 3—3 of FIG. 1. Each of the elongate side frames 12, 14, and 16 have a generally U-shaped cross section as shown in detail in FIG. 3, thereby providing a channel 20 for insertion of a sheet material therein in a well known manner.

Figure 4:
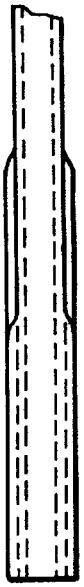
FIG. 4 is an elevational view (partial) looking into elongate side frame 18.
Figure 4:
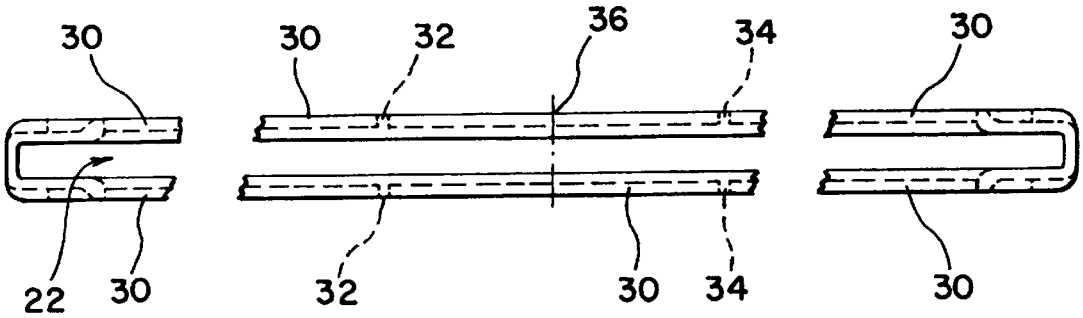
Figure 5:
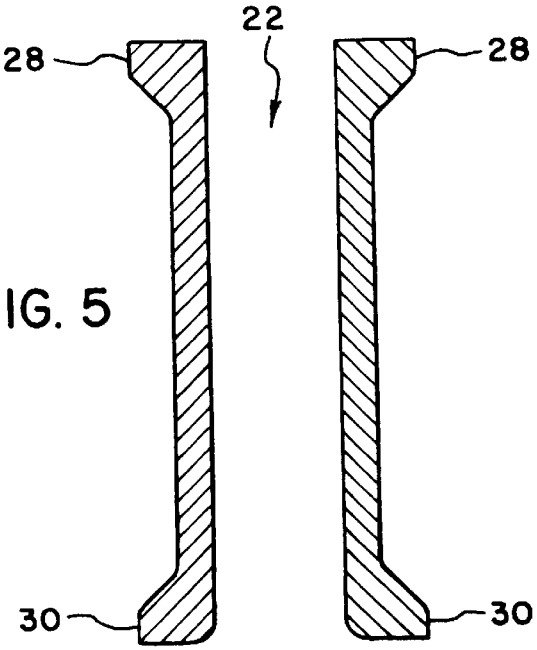
FIG. 5 is a cross-section view of elongate side frame 18 taken through line 5—5 of FIG. 1.

FIG. 4 is an elevational view of elongate side frame 18, looking in towards the open display area 24, and FIG. 5 is a cross-section of elongate side frame 18 taken through line 5—5 of FIG. 1. The fourth elongate side member 18 includes an insertion slot 22, defined by slats 38 and 40, to enable insertion of a display sheet (or sheets) into the frame. It should be noted that, for explanatory purposes, the elevational view of FIG. 4 does not show the biasing of the slats 38 and 40 to a "closed" position, as will be described in more detail below.

As noted above, it is desirable to limit the ability of the display sheet(s) to slide out of the frame once it has been inserted through the insertion slot 22 and into the U-shaped channels 20 but without placing impediments (such as the nibs of Vogler) in the path of the display sheet. To accomplish this, a biasing rib 28 is formed along the inner edge 26 of slats 38 and 40 adjacent to the slot 22. Biasing rib 28 extends outwardly (away from slot 22) from an outer face of slats 38 and 40 along the entire length of the inner edge 26 of slats 38 and 40, and extends around to a portion of the inner edges of elongate side frames 12 and 14, as can best be seen in FIG. 1. A biasing rib 30 is also formed along the outer edge 31 of slats 38 and 40 as shown. Further, biasing ribs 32 and 34 are situated adjacent to a center point 36 as shown, connecting biasing ribs 28 and 30 to each other. Although FIG. 1 shows only the front side of the page frame 10, the back side is a "mirror image" of the front side. Thus, the back side has biasing ribs identical to that described above. See, for example, FIG. 4, which is a cross-section through line 4—4 of FIG. 1, or FIG. 4, which shows the biasing ribs as dotted lines.

Figure 7:
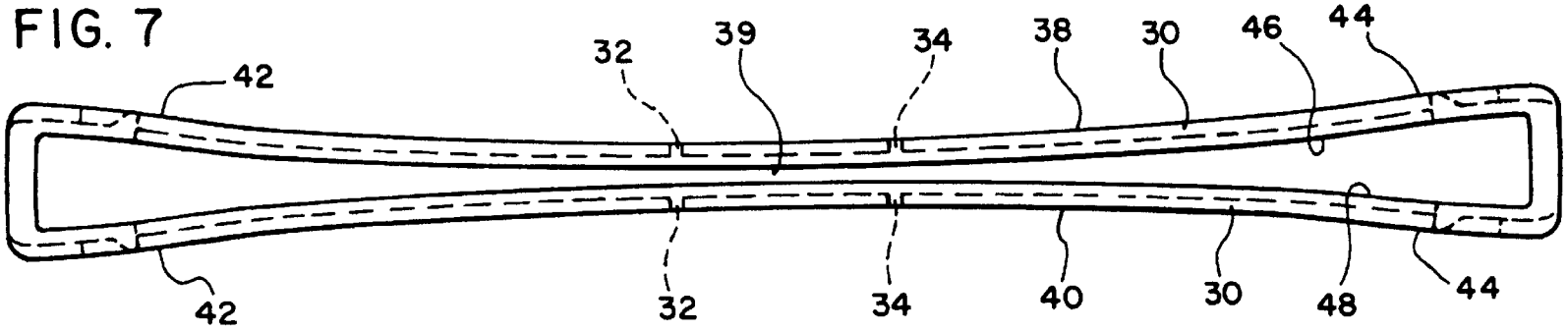
FIG. 7 is an elevational view looking into elongate side frame 18.

In a preferred embodiment, the page frame 10 is injected molded in one piece from, for example, a thermoplastic polystyrene. One such material is "K-Resin" styrene-butadiene copolymer, KRO-1 grade, manufactured by Phillips 66 Company of Houston, Tex. When fabricated as above, the slats 38 and 40 assume a normally "closed" position (as shown in FIG. 7, discussed below). While not wishing to be bound by theory, it is believed that the advantageous results of the invention are obtained because, during the cooling of the molded page frame after the molding process, the biasing ribs 28, 30, 32 and 34 cause the two opposing slats 38 and 40, which form slot 22, to normally bias severely inward to a "closed" position (a position at which the two opposing sides are touching or almost touching, but separable, as shown in FIG. 7). Phillips K-Resin, grade KRO-1, is one example of a material that is sufficiently flexible to allow the slats 38 and 40 to be flexed away from each other when it is desired to insert or remove a display sheet between them, and the slats return to the closed position when the flexing pressure is released. Without the biasing ribs, the opposing slats of a slot may bias slightly inward as discussed in Vogler, but not to a closed position to form a pinch point. However, when the biasing ribs 28, 30, 32, and 34 of the present invention are molded into the page frame 10, the opposing slats 38 and 40 flex severely inward to form a "pinch point" to hold the sample in place.

FIG. 7 is an elevational view similar to the view of FIG. 4, but showing the biasing of slats 38 and 40 to form pinch point 39. The view of FIG. 7 shows how the page frame 10 looks when there is nothing inserted in the frame for display. Referring to FIG. 7, the two slats 38 and 40 of the elongate side 18 are normally in a closed position, thereby "pinching" the display sheet in place. However, they are easily spread open (as in FIG. 3) to allow insertion of the display sheet but, when released, they spring back to the closed position. Thus, when spread open, there is no impediment to the insertion of a display sheet, but once the sheet is in place, the slats 38 and 40 pinch closed to keep the sheet in place.

As shown in FIG. 7, each slat 38 and 40 has a first end 42 and a second end 44. The ends are formed essentially at the intersection of slats 38 and 40 with elongate side frames 12 and 14, respectively. The inner face 46 of slat 38 and the inner face 48 of slat 40 are opposite to each other. The distance between inner faces 46 and 48 is greater at the ends 42 and 44 of slats 38 and 40 than the distance between inner faces 46 and 48 at pinch point 39. In the preferred embodiment, inner faces 46 and 48 are touching are substantially touching at pinch point 39.

In addition to providing a pinch point, the biasing ribs also provide a structural stiffening member, resulting in a more durable and rigid display frame. Further, the biasing ribs provide a protruding surface for adjacent page frames to slide on when several page frames 10 are situated next to each other (like the pages of a book) in a typical display unit. When a customer "leafs through" the page frames of display sheets, there is a tendency for the page frames to rub against each other. As the page frames move on their pivot points, the biasing ribs provide a raised surface for adjacent page frames to slide on when more than one frame is being turned at one time. This minimizes the tendancy of the adjacent frames to catch on each other and jam up the otherwise natural movement of the pages.

Figure 6:
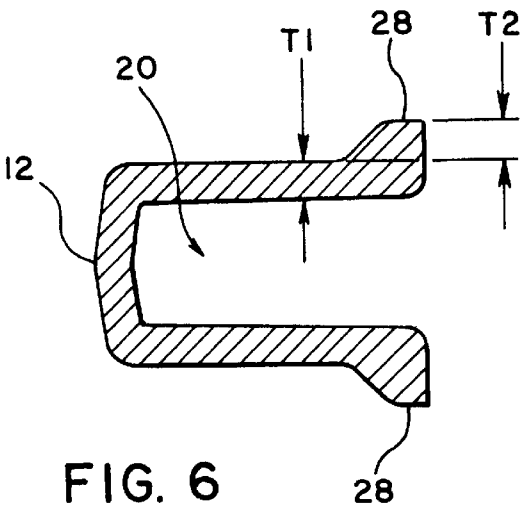
FIG. 6 is cross-section of the left side of the page frame depicted in FIG. 1, taken through line 6—6.
Figure 8:
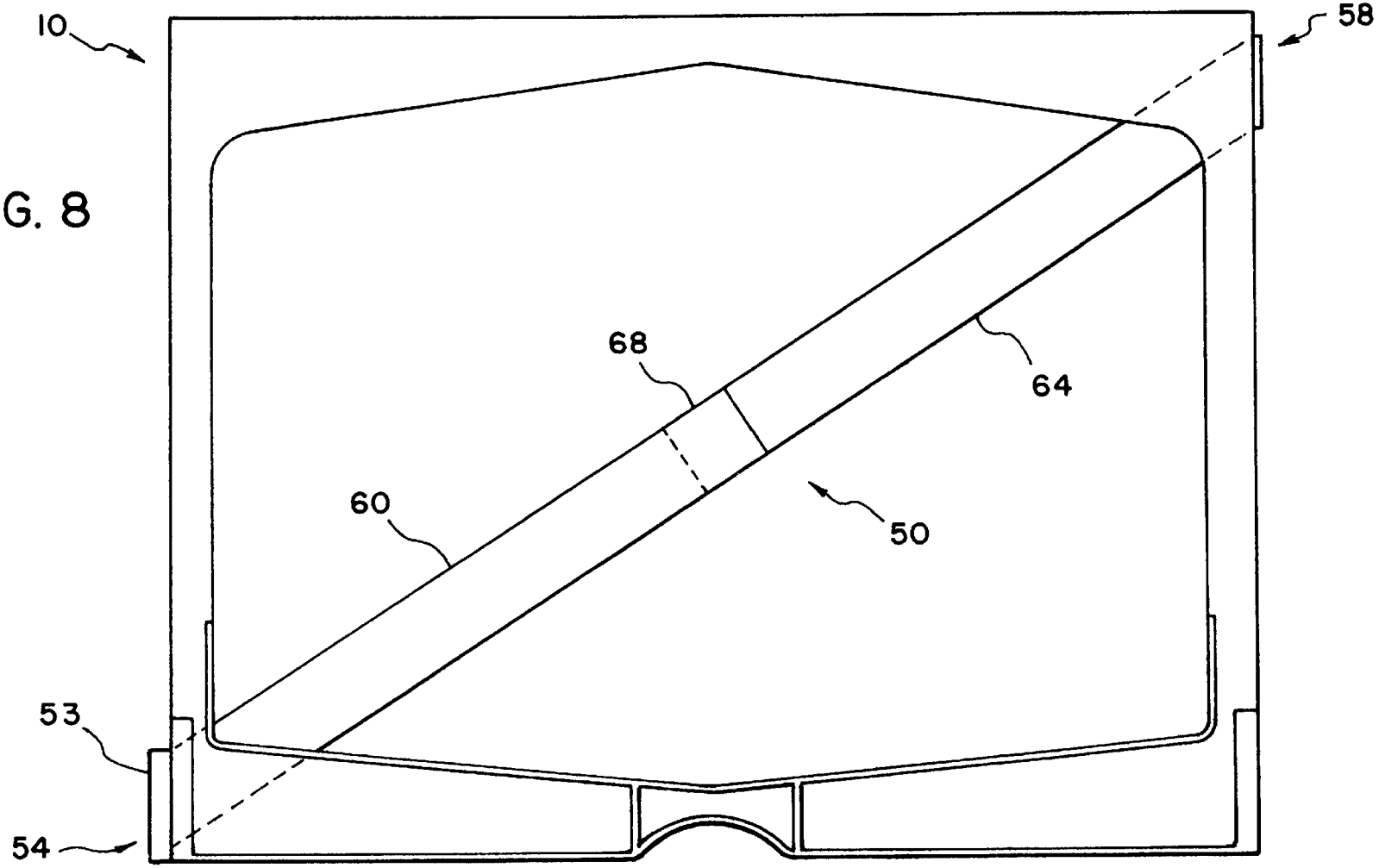
FIG. 8 is a front plan view of a page frame in accordance with the present invention, showing the orientation of truss 50.
Figures 9, 10, 11:
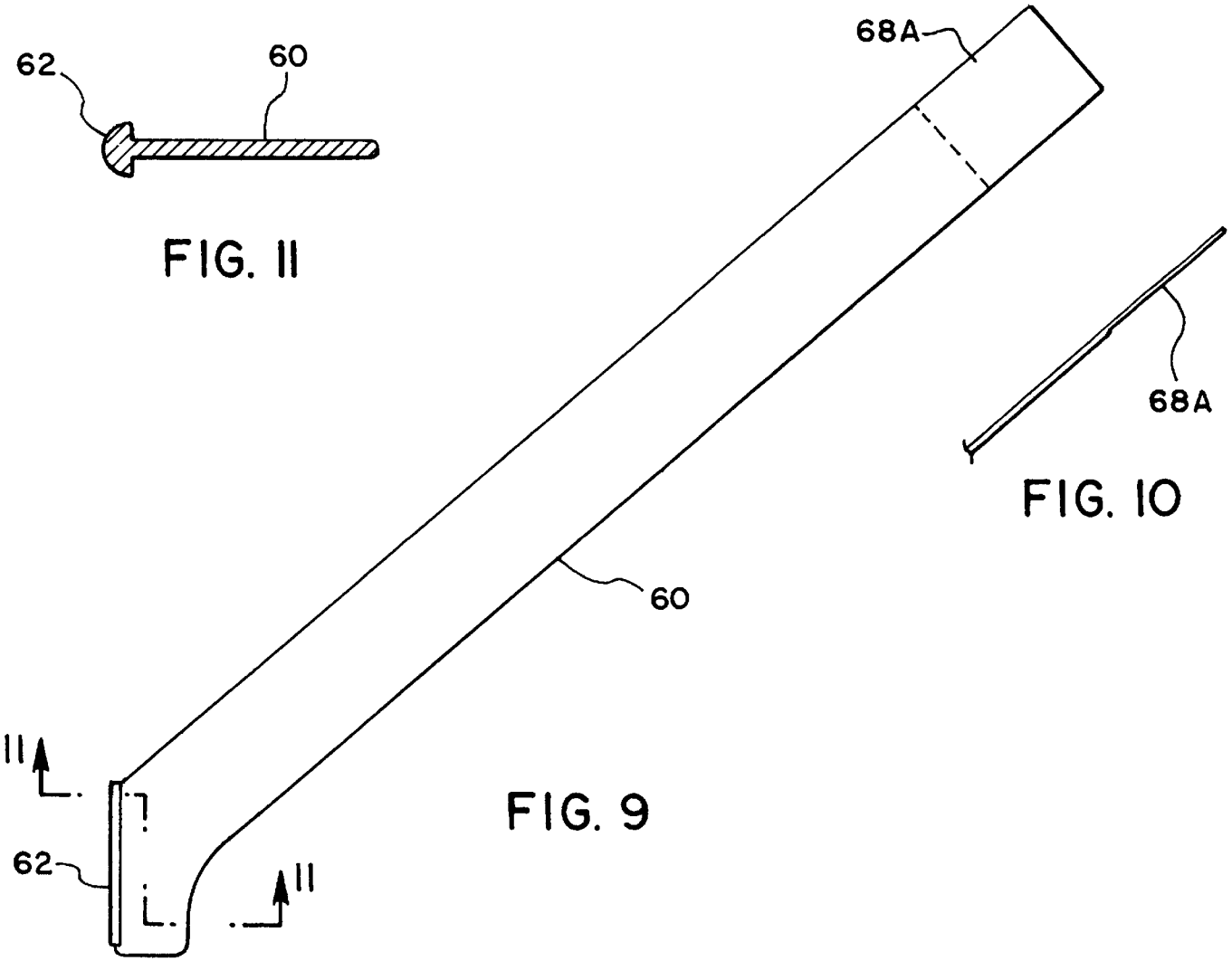
FIG. 9 is a front elevational view of lower truss member 60.
FIG. 10 is a partial side view illustrating end 68A of lower truss member 60.
FIG. 11 is a cross section of lower truss member 60 taken through line 11—11.
Figure 14:
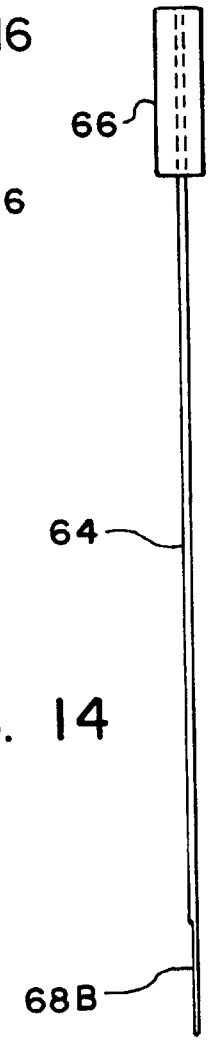
FIG. 14 is a side view of upper truss member 64.
Figure 12:
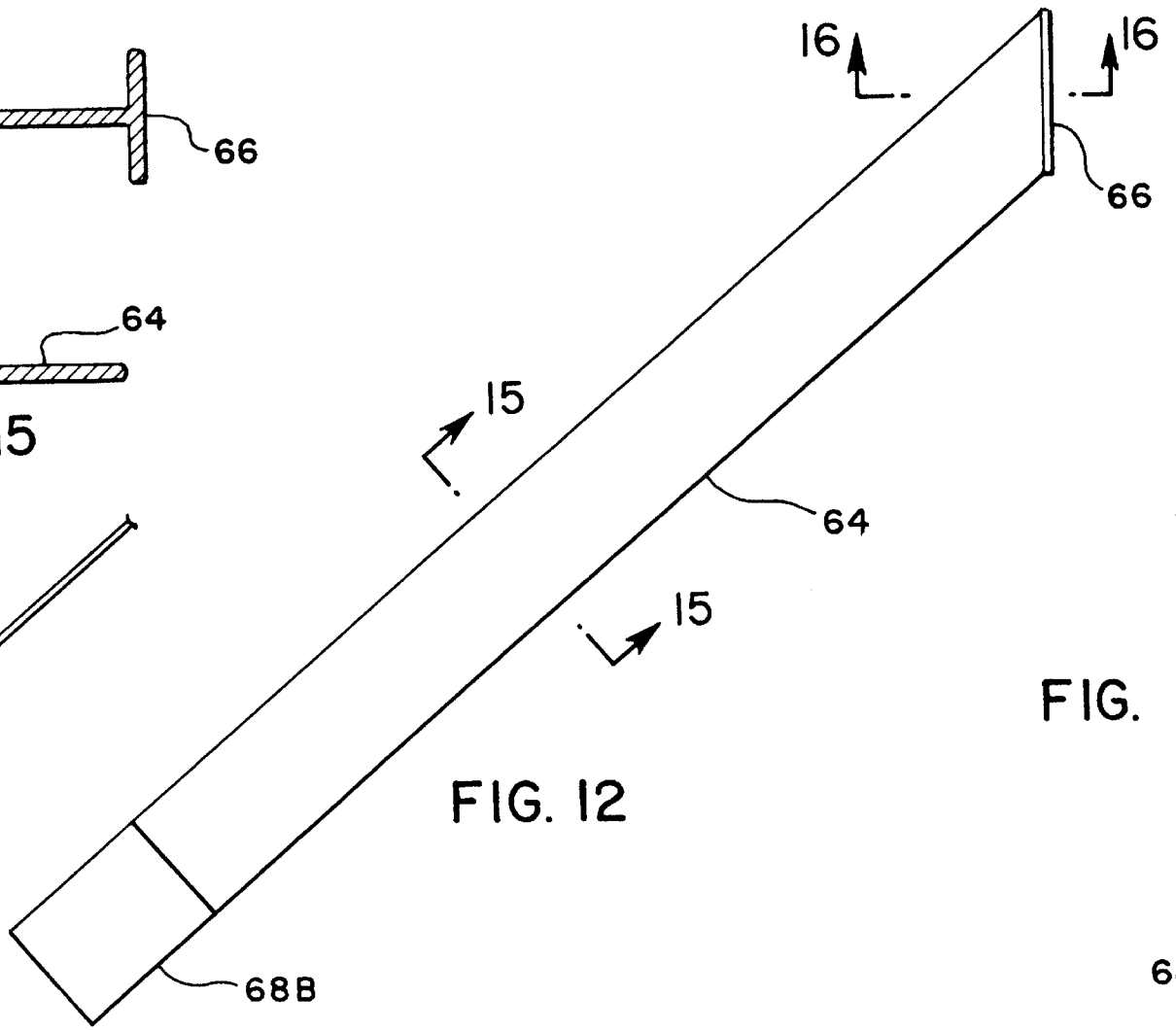
FIG. 12 is a front plan view of upper truss member 64.
Figure 16:
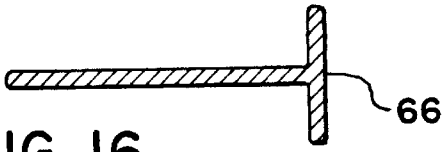
FIG. 16 is a cross section of upper truss member 64, taken through line 16—16.
Figure 15:
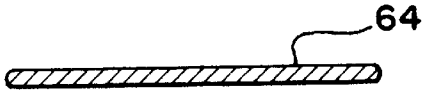
FIG. 15 is a cross section of upper truss member 64, taken through line 15—15.
Figure 13:
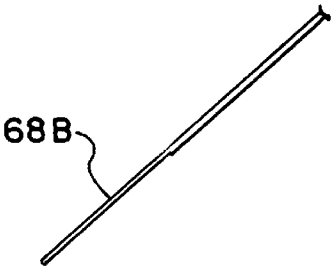
FIG. 13 is a partial side view of end 68B of upper truss member 64.
Figure 17A:
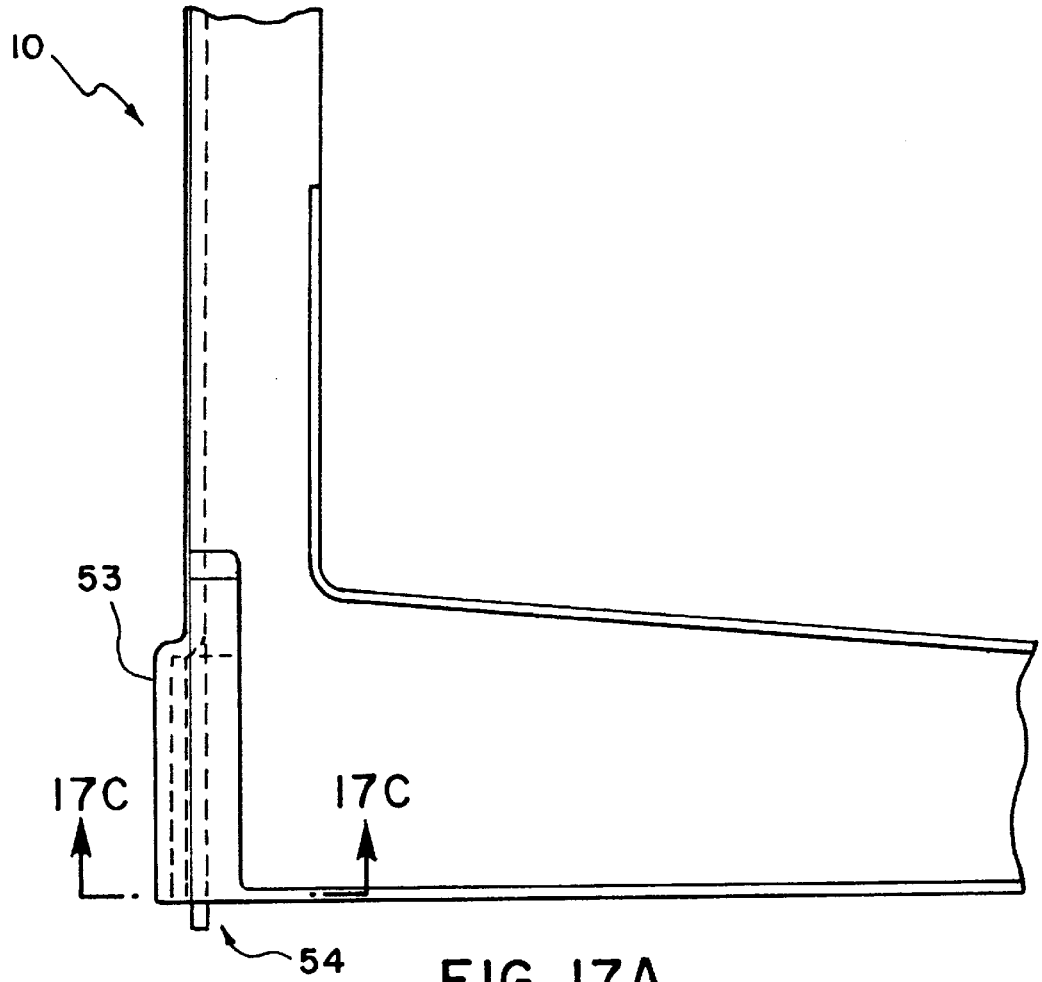
FIGS. 17A–17C are front elevational, bottom, and cross sectional (through line 17C—17C) of lower left corner 54 of display frame 10, respectively.
Figure 17B:
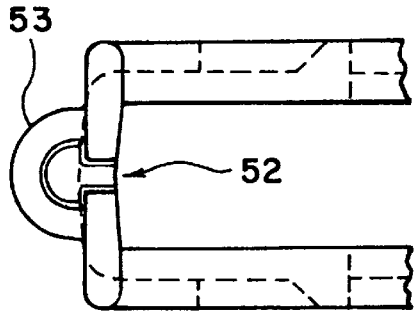
Figure 17C:
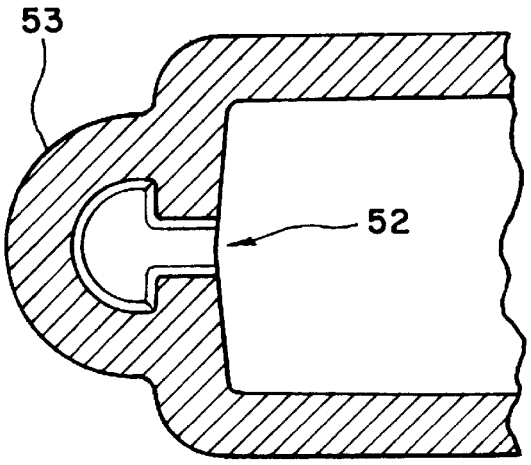
Figure 18A:
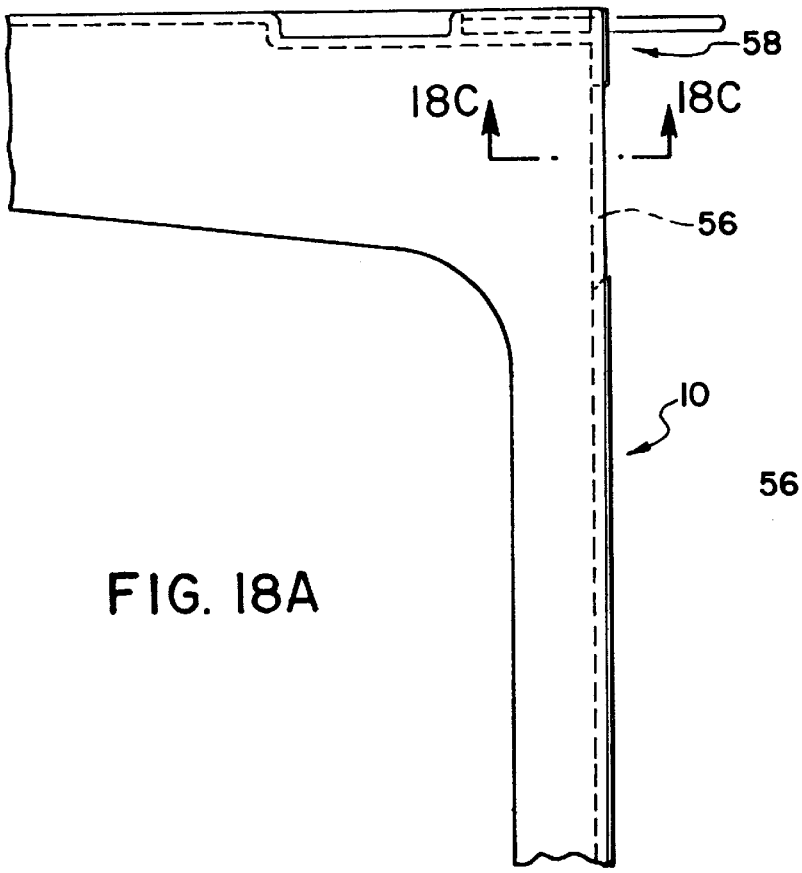
FIGS. 18A–18C are front elevational, side, and cross sectional (through line 18C—18C) views of upper right corner 58 of page frame 10.
Figure 18B:
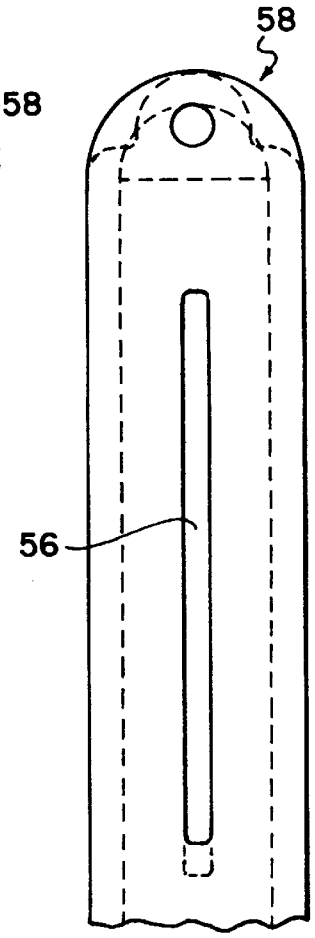
Figure 18C:
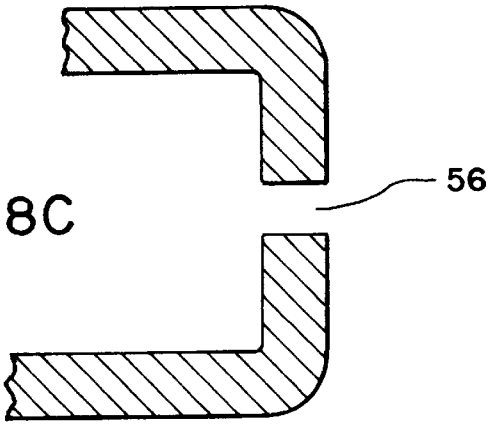

By way of example only, and without limiting construction of the device to these dimensions, a page frame constructed of the above mentioned thermoplastic material and having the following dimensions (or the same proportional dimensions), results in a page frame that forms a pinchpont as disclosed herein:

Thickness T2 (FIG. 3) Approx. 0.100 inches
Thickness T2 (FIG. 6) Approx. 0.120 inches
Width W1 (FIG. 1): Approx. 2.723 inches
Width W2 (FIG. 1): Approx. 1.750 inches
Length L1 (FIG. 1): Approx. 24 inches
Length L2 (FIG. 1): Approx. 18 inches The page frame of the present invention can be constructed in a variety of different sizes to accommodate a variety of different display sheet sizes. One standard sheet size for display is a 26"×28" sheet. When frames of a size to accommodate sheets that are 26"×28" are used, the weight of the display sheet combined with the weight of the frame can cause the frame to have a tendency to sag downward. To counteract the sagging tendency due to the weight of the large sampling page frame, a diagonal reinforcing truss 50, as shown in FIGS. 8–18, is included. The truss 50 can be a single molded unit. However, in a preferred embodiment, the truss 50 comprises a two piece stiffening member that can be connected across the diagonal of the page frame 10 as shown in FIG. 8. The truss 50 can be attached to the frame in a wide variety of manners. In a preferred embodiment, a lower truss member slot 52 and housing 53 is formed in the lower left corner 54 of the page frame 10 as shown in FIGS. 17A–17C, and an upper truss member slot 56 is formed in the upper right corner 58 of the page frame 10 as shown in FIGS. 18A–18C. A lower truss member 60 of the truss 50 is formed with a mating end 62 that is inserted into and mates with the housing 53, and the lower truss member extends through the slot 52. Upper truss member 64 is formed having a mating end 66 that is inserted through upper truss member slot 66.

In this manner, the page frame assembly 10 can be constructed, and then the two piece truss 50 can be inserted therein and glued or otherwise fastened together at point 68 (by connecting 68A of FIGS. 9 and 10 with end 68B of FIGS. 12–14) to complete the diagonal. Since the truss 50 is centrally located in the U-shaped channels of sides 12 and 14, two sheets to be displayed, one on one side of the truss 50 and the other on the other side of truss 50, will hide the truss from the view.

While there has been described herein the principles of the invention, it is to be understood by those skilled in the art that this description is made only by way of example and not as a limitation to the scope of the invention. Accordingly, it is intended by the appending claims, to cover all modifications of the invention which fall within the true spirit and scope of the invention.

What is claimed is:

1. A display device, comprising:

first, second, third, and fourth side frames connected at their ends to form a rectangle, said first, second and third side frames having a channel-shaped cross-section, said fourth side frame comprising first and second slats, wherein each of said slats has a planar inner face and an outer face and wherein each of said slats includes at least one rib protruding from its outer face wherein said first and second slats are biased towards each other so that said planar inner faces of said first and second slats form a pinch point therebetween.

2. A display device according to claim 1, wherein said display device is used to display generally planar sheet materials, and wherein said first and second slats are deformable away from each other to form a slot there between, thereby allowing said sheet materials to be inserted between said first and second slats.

3. A display device according to claim 2, wherein said pinch point exerts pressure on any sheet materials inserted between said first and second slats, thereby holding said sheet materials in place within said display device.

4. A display device as set forth in claim 3, wherein each of said slats has a plurality of ribs extending lengthwise along said length.

5. A display device according to claim 1, wherein said slats have a length and wherein said rib extends lengthwise along said length.

6. A display device as set forth in claim 5, wherein said rib extends lengthwise along the entire length of said slats.

7. A display device as set forth in claim 6, wherein said ribs further extend along a portion of said first and second side frames.

8. A display device as set forth in claim 1, wherein said first and second slats each have first and second ends at their intersection with said first and second side frames, respectively, and a center point located between said first and second ends, and wherein said first and second slats are of a first width at said first and second ends and are of a second width at said center point, and wherein said first width is greater than said second width.

* * * * *